US011399693B2

(12) United States Patent
Aleali

(10) Patent No.: US 11,399,693 B2
(45) Date of Patent: Aug. 2, 2022

(54) ERGONOMIC INTELLIGENT DISHWASHER

(71) Applicant: Amin Aleali, Clayton, CA (US)

(72) Inventor: Amin Aleali, Clayton, CA (US)

( * ) Notice: Subject to any disclaimer, the term of this patent is extended or adjusted under 35 U.S.C. 154(b) by 204 days.

(21) Appl. No.: 16/792,274

(22) Filed: Feb. 16, 2020

(65) Prior Publication Data

US 2021/0251463 A1 Aug. 19, 2021

(51) Int. Cl.

| | |
|---|---|
| ***A47L 15/24*** | (2006.01) |
| ***A47L 15/00*** | (2006.01) |
| ***A47L 15/46*** | (2006.01) |
| ***A47L 15/42*** | (2006.01) |

(52) U.S. Cl.

CPC ..... *A47L 15/248* (2013.01); *A47L 15/0086* (2013.01); *A47L 15/0092* (2013.01); *A47L 15/242* (2013.01); *A47L 15/246* (2013.01); *A47L 15/4221* (2013.01); *A47L 15/4244* (2013.01); *A47L 15/4248* (2013.01); *A47L 15/4274* (2013.01); *A47L 15/4285* (2013.01); *A47L 15/4291* (2013.01); *A47L 15/46* (2013.01)

(58) Field of Classification Search

None

See application file for complete search history.

(56) References Cited

U.S. PATENT DOCUMENTS

| | | | | |
|---|---|---|---|---|
| 4,561,904 A * | 12/1985 | Eberhardt, Jr. | ..... | B65G 43/08 134/72 |
| 9,603,502 B2 * | 3/2017 | Park | ..... | A47L 15/23 |
| 2019/0167068 A1 * | 6/2019 | Yoon | ..... | A47L 15/46 |

* cited by examiner

*Primary Examiner* — Rita P Adhlakha

(57) ABSTRACT

Ergonomic Intelligent Dishwasher comprising of closed-loop carousel system, tableware storage holder and a Wash-Pod. Individual tableware is inserted through an opening where the tableware attaches to a closed-loop, speed-adjustable carousel-system that moves the individual tableware, in a queue-fashion, through one or more wash cycle as the attached-tableware travels towards the tableware separation-mechanism. Tableware separation-mechanism is activated or deactivated for each individual tableware in the said queue on the carousel based on user-define setting or an internal quality-control process, thus, when deactivated, attached tableware on the carousel continues to travel through additional said cleaning cycle in the loop until such time when carousel-tableware separation-mechanism is activated. Once the tableware is discharged and separated from the carousel, the tableware is directed to one or more tableware storage holder. As part of the same unit, Wash-Pod is a housing within the unit with closeable lid for washing kitchenware items based on user parameters.

20 Claims, 13 Drawing Sheets

ERGONOMIC INTELLIGENT DISHWASHER

Here and present invention is the continuation of the provisional patent application 62/809,680 filing date of Feb. 24, 2019.

BACKGROUND

Ever since human discovered fire and made pots and dishes out of rudimentary materials such as mud, clay and wood for cooking and food consumption, washing tableware has been a constant never-ending labor-intensive task. With an average of three meals a day, an individual uses many kitchenware and tableware that needs to be washed after use to prevent mixing of food flavors and for sanitary reasons. In a residential setting, an average family soils hundreds of pieces of tableware and kitchenware in a week. An automated system for washing kitchenware and tableware in a residential setting, due to limited floor space, power, ease-of use and other limiting factors, have specific challenges. To address those challenges, rack-based dishwashers have been a common solution since late 1940s. A typical rack-based dishwasher is a box-shaped appliance with a front door and one or more outward-extendable racks on sliding rails. A tub at the bottom of the dishwasher is filled with hot water and detergent. The user places a mixture of tableware and kitchenware pieces on the one or more mentioned racks and closes the water-sealed door. Tableware and kitchenware on the racks are then washed in bulk inside the dishwasher by spraying and saturating the pieces on the mentioned racks with soapy water. A pump connected to the bottom tub recycles tub's soapy water using stationary or moving spray jets within the unit. Typically, an electric water-heater element is also present to bring the water temperature to an acceptable level.

In a household setting, often the residential dishwasher unit is located near the kitchen sink. In such setting, the user transfers the tableware and kitchenware from sink area on one or more dishwasher rack. Once the rack(s) are at the full capacity, detergent is added, the dishwasher door is closed, and the user chooses a preset wash-cycle which can take between 30 minutes to 90 minutes. At the end of the cycle, the user is required to remove the clean dishes from the racks so that a new set of soiled tableware and kitchenware can be placed on the racks for the next dishwasher wash-cycle.

The same basic method of cleaning and design of racked-based dishwashers for residential and household settings have been the same for more than 70 years with no or very little significant change in the basic principal. With hundreds of millions of dishwashers currently in use in the residential setting and elsewhere, any improvement to mentioned dishwashing process will have a large impact to the overall quality of life and the environment all over the world.

A critical disadvantage of the current and available dishwashers is that the user is required to bend down and twist multiple times to place items on the dishwasher racks. Such repetitious bending down and twisting, at times day after day, creates an unnecessary fatigue for a healthy individual, and a great burden and hardship for elderly, disabled and pregnant individuals. Beside the physical hardship, washing tableware and kitchenware in bulk is a game of chance. For example, any pieces of tableware or kitchenware physical contact to adjacent tableware or the rack itself produces one or more blind spot which prevents the detergent and hot water reaching those areas for cleaning, degreasing and spot removal. Further, throughout the racked-based dishwasher wash-cycle, the user has lost all access to the items inside the dishwasher until the wash cycle is completed. This is true even though some of the piece being washed do not need a full upwards of 90 minutes of washing and drying. Such long duration stems from the fact that, in the rudimentary design of bulk-washing such as the current rack-based dishwashers, the most single soiled piece of tableware is the deterministic factor of the duration of the cycle for everything else within the dishwasher. In bulk-washing, a cup used for drinking water goes through the same wash cycles as the plate having dried food, grease and food spots on it. This is true even though the amount of time, water, detergent and energy for cleaning the mentioned cup is a fraction of cleaning the plate in the same wash cycle. This results in inefficiencies that bulk-washing such as current and available dishwashers cannot resolve.

Further, current residential dishwashers put the user in a self-defeating predicament. If the user starts the dishwasher cycle with less than full capacity (such as single bowl or a plate), any predefine washing cycle results in mass-inefficiency in terms of time, energy and detergent. If the user waits until enough dirty tableware are accumulated to fill the dishwasher to its full capacity and then start the washing-cycle, then such waiting time now entails that more energy and time is spent to remove dried grease and food spots on the tableware that have been sitting on racks for possibly days. Therefore, the user, and not the dishwasher, must get all variables exactly right for optimal efficiency in electricity, water and detergent usage.

Another critical disadvantage of racked-based dishwashers is that once the wash cycle is over, the dishwasher is unusable unless and until the user removes the clean tableware from the racks first, which entails another series of repetitious bending down and twisting. Further disadvantage is that any piece of tableware or kitchenware deemed uncleaned will need to through another complete wash cycle among the other dirty dishes which wastes time, water, detergent and energy.

In a commercial establishment such as restaurants or hotels, depending on the volume, one or more paid staff is allocated for washing kitchenware and tableware either manually or using a commercial-grade dishwasher to meet the demand of the business. Commercial dishwashers can take up the entire room (U.S. Pat. Nos. 5,927,309 and 3,612,253) and costs thousands of dollars. Because of the high-output requirement, most commercial dishwashers offer a horizontal conveyor belt which moves the soil kitchenware and tableware through the washing process (EP2254454B1 and EP2648594B1, U.S. Pat. No. 5,287,866 and US5329952). Commercial dishwashers are simply not practical in places such as residential settings, small businesses and company breakrooms where floor space, ceiling clearance, weight, electrical power requirement and noise-factor are restricted or limited.

Venues such as residential households such as an average household dwelling, apartments, company breakrooms and small businesses have its own challenges when it comes to washing kitchenware and tableware. A residential dishwasher must be user-friendly for a senior citizen, pregnant or disabled individuals to utilize. A large majority of prior-art relating to the residential dishwashers relates to rack-base dishwashers with the aim to mitigate its short-comings by improving specific problem areas both in terms of functionality and usability. For example, in U.S. Ser. No. 10/299,657B2, the bottom rack is moveable vertically by means of a motorized corkscrew which shortens the distance between the user and the bottom rack. To make the rack-based dishwasher more user-friendly, in US20040163684A1, a motorize door opens and closes with enough force to create a water-seal around the edges. In U.S. Ser. No. 10/368,718B2, to counter-affect the bulk-washing, water and detergent is delivered directly to the cups by creating a series of hallow pathways through the rack. To save space, wall-mounted dishwashers have been purposed (see EA01816081). To prevent repetitious of bending down to add dishwasher detergent, in U.S. Pat. No. 7,931,032B1, a large detergent chamber makes the rack-space dishwasher more user-friendly "by reducing the repetitive step of loading detergent and allowing "peace of mind" delegation of the dishwashing task."

In sum, my invention offers a "dishwasher" that fits within the routine of a today's typical household where the immediate need for tableware are fulfilled on-demand. What use to work in 1940's and 1950's with rack-based dishwasher no longer fits within our lives today. We are in time and age where the fast pace of life does not permit spending time to empty the dishwasher first from the previous cycle, then load the dishwasher with soiled dishes, and then wait between 30 to 90 minutes for dishwasher to finish the cycle. The present invention creates a situation where, if you need a tableware (such as a plate), you take one from the top of the stack, use it, and then place it in the insertion-point of the carousel system. The present invention will take that plate and put it through one or more wash-cycle and places the clean plate back on top of the stack for the next use.

My Invention offers a comprehensive solution to the shortcomings in the way we clean kitchenware and tableware in a limited floor-space environment.

My Invention creates an ergonomic process and environment for the user to clean kitchenware and tableware by eliminating the repetitious requirement for awkward-body movements such as bending down and/or twisting while using the dishwasher.

My Invention, by utilizing the carousel system, shortens the wash-cycle to fulfill the immediate tableware requirement by offering an on-demand washing capabilities that saves time, energy, water and detergent.

My Invention allows single tableware to go through more than one wash-cycle for acceptable cleaning and sanitizing, without manual intervention, based on preset parameters by the user, or by internal dynamic quality-assurance monitoring process.

My Invention minimizes tableware critical surface-area blind spots for optimal cleaning, spot removal, sanitization and drying.

DESCRIPTION OF DRAWINGS

FIG. 9 shows an embodiment where the top sprocket is offset relative to the bottom sprocket whereby the connecting roller chain or the belt travels in diagonal fashion for purpose of creating more space at the insertion point. The extra space at the insertion point is allocated for and as the "standby" area for the tableware waiting to be attached to the carousel. The standby area is useful for tableware-carousel attachment timing and to create enough room for any tableware already attached to the carousel system going through additional wash cycle to pass through.

FIG. 13 is an illustration of roller chain attachment where the cross-plate platform can be attached to.

DESCRIPTION

The present invention is described in enabling detail in the following examples, which may represent more than on embodiment of the present invention.

"Tableware" as it relates to the present invention is any item that is used for direct food consumption. Examples of tableware are flat plates, bowls, cups and silverware such as spoons and forks.

"Kitchenware" as it relates to the present invention is any items that is used to prepare and cook the food for consumption using tableware. Examples include pots and pans.

"Carousel" as it relates to the present invention is a closed-loop rotating means that carries the items attached to it through one or more wash cycle.

"Contact-point" as it relates to the present invention is one or more area of the tableware that attaches to the closed-loop carousel system.

"Insertion point" as it relates to the present invention is an area where the tableware is attached to the carousel or rests in stand-by state to be attached to the carousel system.

"Discharge point" as it relates to the present invention is an area where the tableware is separated from the carousel system after going though one or more wash cycle.

Figure 1:
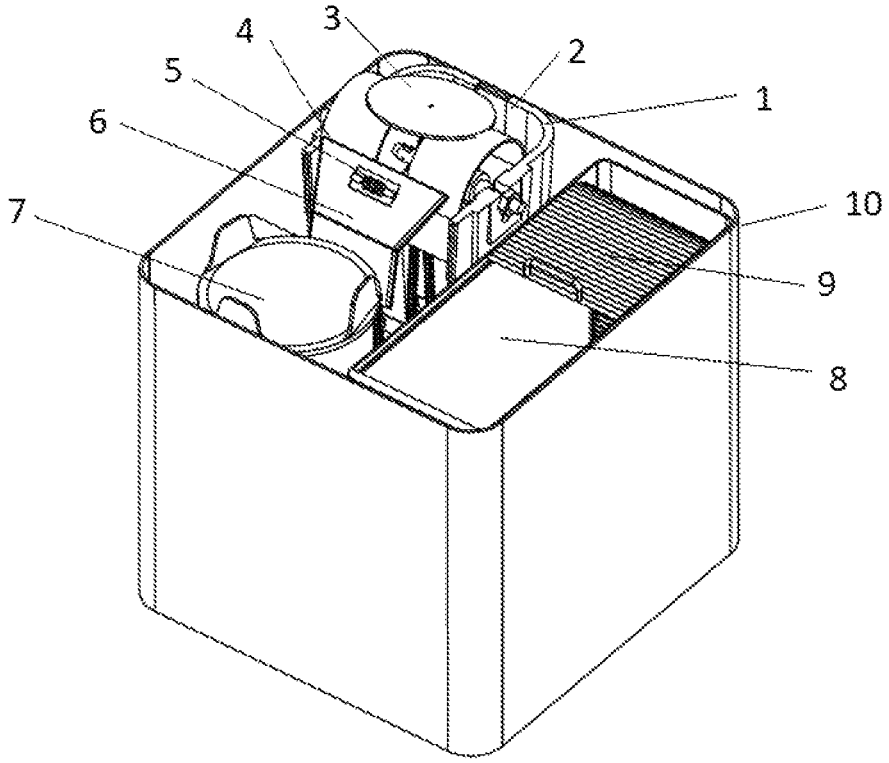
FIG. 1 Overall basic view of preferred embodiment showing three main sections: carousel system, dish stacker and Wash Pod positioned within a housing.

FIG. 1 shows the overall basic view of one preferred embodiment of the present invention (top cover removed from the carousel housing 1). Each section is described below in details. Tableware item 3 is inserted through the insertion point 2. In this embodiment, the tableware attaches to the carousel system contact-point platform which is a belt or a chain which travels in a substantially vertical or diagonal orientation. The carousel system, using at least one driver and one idler sprocket, a connecting chain or belt, using one or more contact-point platform, carries the tableware through the wash-cycle as the tableware approaches the discharge point 4. As shown in FIG. 1, in this embodiment, two sets of upper and bottom sprockets with two roller chains, each connecting to one set of upper and lower sprocket, carry the contact-point platform through the rotation. The contact-point platform is a cross-plate connector between the two rotating chains. At the discharge point 4, the tableware is separated from the carousel system and the tableware is guided using rollers 5 and pathway 6. Gravitational force slides the tableware on top of the dish stacker 7. By user preference or by an intelligent internal quality-control process, the discharge point 4 can be disabled for the approaching tableware on the rotating carousel thus the approaching-tableware can continue and go through more than one wash-cycle until the discharge point 4 is enabled for that tableware. As shown in FIG. 1, Wash Pod 8 is a deep housing with a sliding lid 9 designed for washing odd shaped items such as pots and pans. The whole unit is contained with the housing 10. The lid of the Wash Pod is designed as a rolling lid whereby if the unit is situated and installed in an island counter in the kitchen, the items inside the Wash Pod would be accessible from all sides of the counter without the lid blocking any vertical space.

Tableware and Kitchenware Compliancy

For the utilization of the carousel system which is detailed below, the tableware and kitchenware items need to be compliant to and for the carousel-system design in terms of tableware overall maximum dimensions and weight, shape and durability, as well as the overall means of the items attaching to the carousel contact-point platform. For example, if the means of attaching the tableware to the carousel system is by suction cups, then the compliancy simply requires that a smooth surface for the contact-point on the tableware backside to be present. The contact-point platform utilizing one or more suction cup can target such area to create the hold-force necessary to attach the tableware to the carousel contact-point platform. If the means of attaching the tableware to the carousel system is by magnetic force, then a metallic surface area on the tableware is required to meet the compliancy.

This compliancy can be met at the time of tableware manufacturing, or an after-market kit is provided to transform any current tableware that meet the overall maximum dimension and weight, shape and durability, into the compliancy in terms of contact-points between the item and the carousel system.

In another embodiment, a standalone meshed basket that can be attached to the carousel system that holds the tableware inside and in position throughout the wash-cycle. Such mesh basket particularly useful for washing silverware such as spoons, forks, knives and other tableware items. Subsequently, the basket is attached via the mentioned means to the carousel system.

Figure 10:
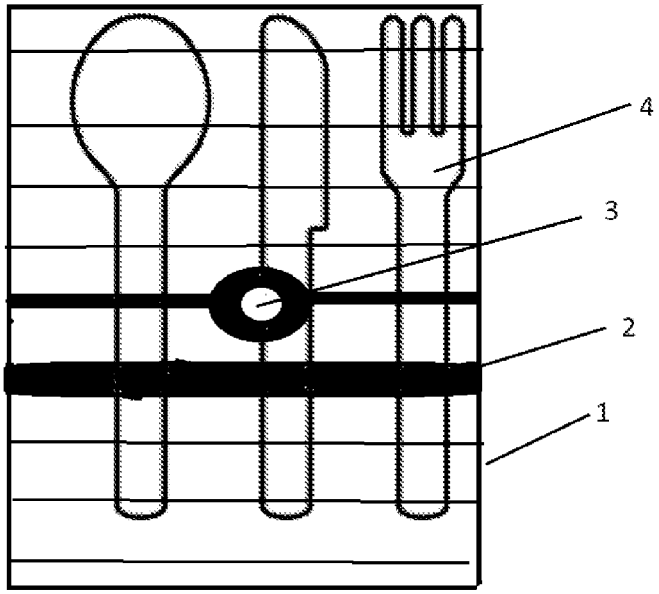
FIG. 10 shows an embodiment of a carousel-compliant holder for tableware items such as spoons, forks and knives so they can be inserted into the carousel system for washing. Similar holder applies to cups (not shown).

As FIG. 10 illustrates the backside of a holding adapter basket for the carousel system. The holding adapter is a meshed basket that allows soapy water to reach the items inside while preventing the items inside from falling off the holding-adapter basket. Items such as spoons, forks, knives 4 (or cups not shown) are placed within holding adapter housing 1. The items can be placed in an orderly fashion with means 2 to keep them in position throughout the wash-cycle. In such case, the front side of the holding adapter basket may be open. In another embodiment, the items can move and tumble within in an enclosed basket to prevent blind spots according to the carousel rotational position and movement. In such case, the holding adapter is an enclosure to prevent the items from falling into the carousel housing. Contact point 3 in FIG. 10 is the area where the holding adapter basket contacts the carousel system contact point platform.

Critical Surfaces

A tableware such as a dish has two relevant surface areas, 1) Critical surface area and 2) non-critical surface area. Critical surface area herein is defined as the area of the tableware that is in view and where food makes contact to such surface. For example, a dish, while on the table, is normally facing up with its critical surface area exposed. Non-critical surface area is normally out of view and does not contact food. An example of non-critical surface area is a back of a dish which is the opposite side and is away from the critical-surface area. The edge of the tableware is considered critical surface area since it is exposed. Thus, any tableware resting vertically on a rack using gravity has one or more blind spots on its critical surface area of the edge of the tableware and the rack. Such distinction is important since the goal is to eliminate any blind spots as it relates to the critical surface area of the tableware and minimize any blind spot in non-critical surface of the tableware.

Figure 2:
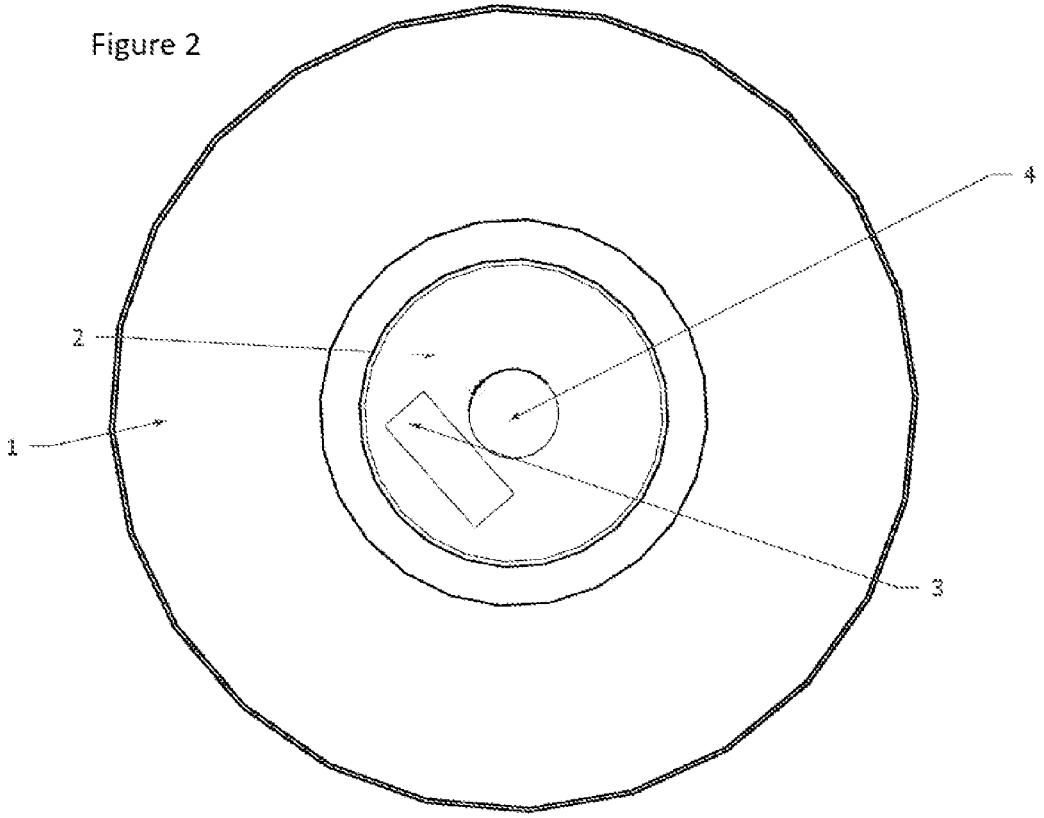
FIG. 2 shows the back of a tableware (a dish as an example) illustrating one embodiment of contact-points with the carousel. In addition, it illustrates possible embodiment with identification markings that provides details about the tableware attributes such as size, shape, weight and durability.

FIG. 2 is displaying a non-critical surface, backside of a tableware (shown as plate). Depending on means of attaching the dish to the carousel system, minimum area on the non-critical area of the tableware is designated as one or more contact-point between the tableware and the carousel system with sufficient hold-force to keep the tableware positioned and attached to the carousel system as the dish passes through different stages of the wash cycle. As shown in FIG. 2, in this embodiment, a single point at the center of the backside of the dish 4 is designated as the contact-point in noncritical area of the tableware 2.

The means of attaching the tableware to the carousel system can be achieved by the tableware exerting the hold-force to the carousel system, or the carousel exerting the hold-force to the tableware, or both the tableware and the carousel system exerting hold-force on each other at one or more contact-point. Many different means of attaching the tableware to the carousel are explained below.

For optimal efficiency, optionally identification markings such as, lettering, bar code, RFID chip or QR code may be placed on the tableware to convey such information as dimension and weight and other guidance and attributes relating to the tableware and its cleaning instructions. Examples of such instructions include but not limited to water temperature and water-pressure, as well as microcomputer-controlled wash-zone jet-spray nozzle activation configuration for optimal cleaning reach for degreasing and spot removal. As an example, FIG. 2 shows a QR code or bar code markings in the backside of the tableware 3. The identification markings may contain mentioned information in addition to a Uniform Resource Locator (URL) where the information about the tableware item itself can be fetched over the internet using TCP/IP protocol. Once downloaded such information is optionally cached and saved by carousel intelligent-processing unit for now and for future use. Additionally, such information about the tableware may include the tableware's image in a clean state to be utilized by the internal quality-control image-comparison logic as the base template.

Carousel System

The objective of the carousel system is to move one or more pieces of tableware individually through one or more wash-zone within the carousel housing.

Figure 12:
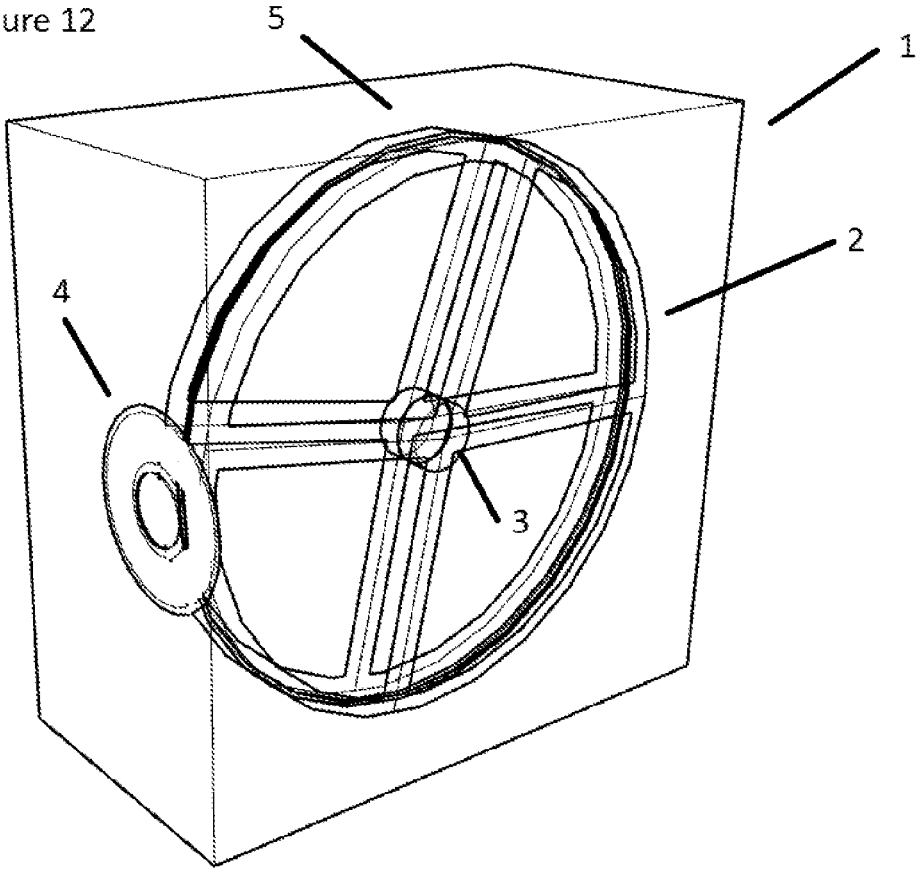
FIG. 12 is an illustration of another embodiment of a rotation platform that puts the tableware through one or more wash cycle.

In one embodiment such as FIG. 12, the carousel system is a solid surface 2 that rotates on its axis 3 with in a housing 1. The shape of such solid surface can circular or polygon. At the insertion point 5, single tableware 5 is attached to the edges or the surface of such rotating solid surface as it goes through one or more wash cycles until it is separated from the mentioned solid surface at the discharge point. In this embodiment, the insertion-point and discharge-point are in the same location.

Figure 3:
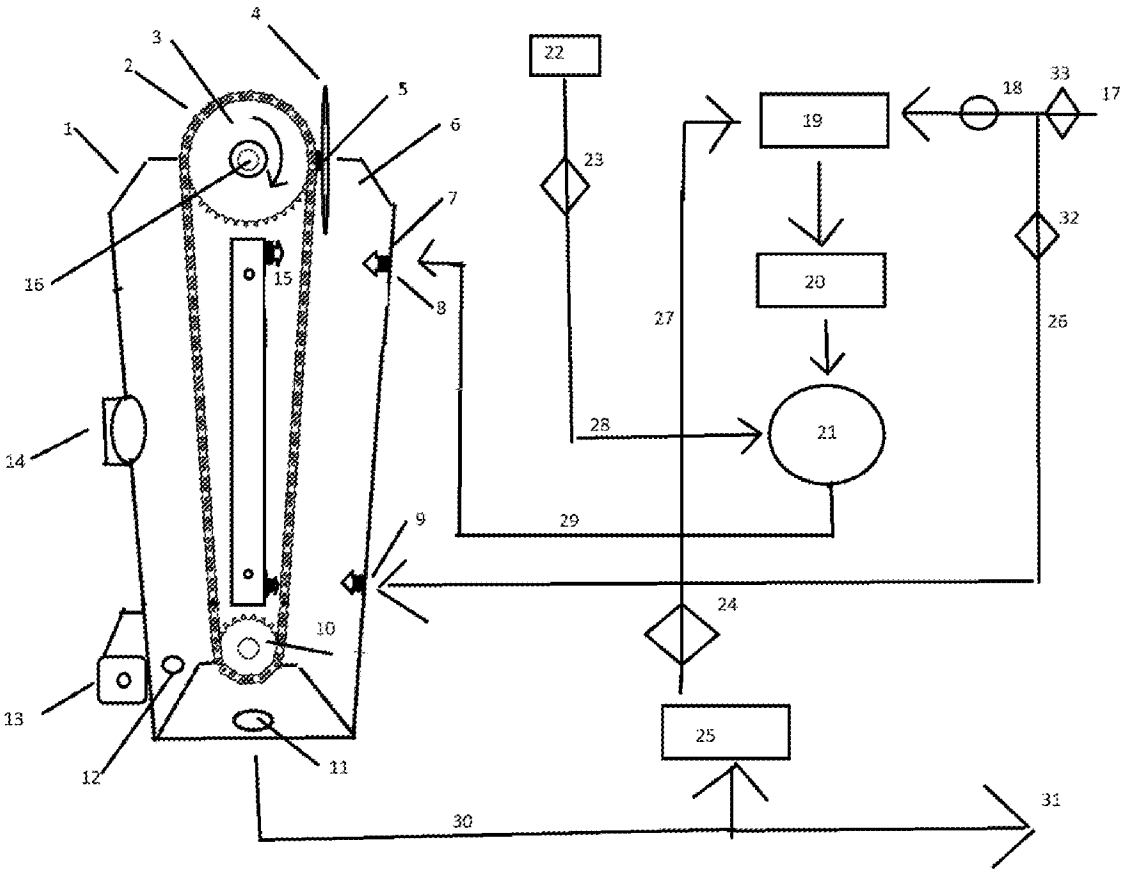
FIG. 3 shows the cross-section of one embodiment of the carousel system with the top and side cover removed to display the details of the invention.

In another embodiment, the rotating carousel is a closed-loop system with at least one roller chain or belt that rotates using at least two sprockets or pulleys positioned apart (FIG. 3).

FIG. 3 shows such embodiment with upper sprocket 3 is joined with lower sprocket 10 using a roller chain 2. A bearing 16 is attached to the upper sprocket 3 to create a free-spinning idler sprocket with sprocket 10 as the driver sprocket.

In one embodiment, the driver diameter and idler sprocket diameter or pulley diameter can be the same or different dimension for space consideration at insertion and/or discharge point as well as mechanical advantage.

In one embodiment, the driver and idler can be offset relative to each other wherein the connecting chain or belt travels in a diagonal fashion within the housing.

In one embodiment, the said chain or the belt is metallic or have sufficient metallic compound in its composition to provide sufficient magnetic attraction-force with a magnet.

In one embodiment, the said chain or the belt, as well as the driver and idler sprocket are metallic or have sufficient metallic compound in its composition to provide sufficiently conduct electricity.

On the outer edges of the carousel, there can be one or more places and means for tableware to attach itself to the moving carousel chain or belt 2 directly. In another embodiment, the tableware 4 attaches to the carousel via one or more contact-points platform 5 that are attached and are rotating with the carousel belt 2.

In another embodiment, the contact-point platforms can also move independently on a railing using magnetic levitation concept with just-in-time electromagnetic pole management.

In one embodiment, the rotation of the carousel can be done manually or by a motor 13 using pulley and belt connected to the driver sprocket 10 (in FIG. 3, such assembly is on the backside of housing 1 and not shown). In another embodiment, the motor spins the carousel driver sprocket using gearbox to achieve the necessary torque required for the operation.

Tableware 4 is inserted at the insertion-zone 6 attached to the contact-point platform 5 that is attached to rolling chain 2 which rotates with the sprockets 3 and 10 via the motor 13 in the carousel housing 1. The tableware 4 is passed through one or more nozzles, or one or more banks of nozzles 8 and 15 as wash-zone and one or more nozzles 9 as rinse zone. In one embodiment, a position sensor 7 keeps track of the position of contact-point platform to turn on or turn off different wash zones to conserve water, electricity and detergent.

The rotational speed of the carousel is determined and controlled by preset setting such as "Fast," "Medium" or "Slow," or the user manually controls the speed of the carousel rotation using a potentiometer that limits the flow of electricity to the carousel motor 10. Carousel motor 10 rotation speed can also be controlled through a control-panel that controls the speed of the motor using a solid-state component to adjust the flow of power to the motor.

In one embodiment, the motor is controlled by microcontroller with one or more homing, or positioning sensor to determine the position of the carousel relative to the insertion point, discharge point and different wash zones.

In another embodiment, the motor is a stepper-motor with fine-grain control for rotational positioning and rotational speed using Pulse Width Modulation (PWM) or similar control-signaling logic.

Figure 8:
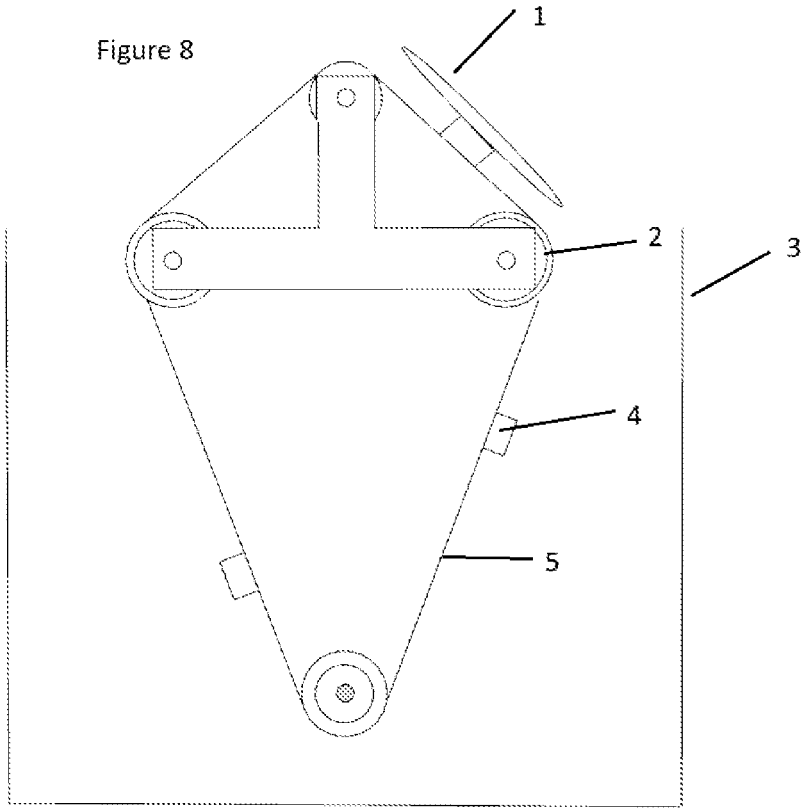
FIG. 8 shows another embodiment of the carousel system chain or belt configuration.
Figure 9:
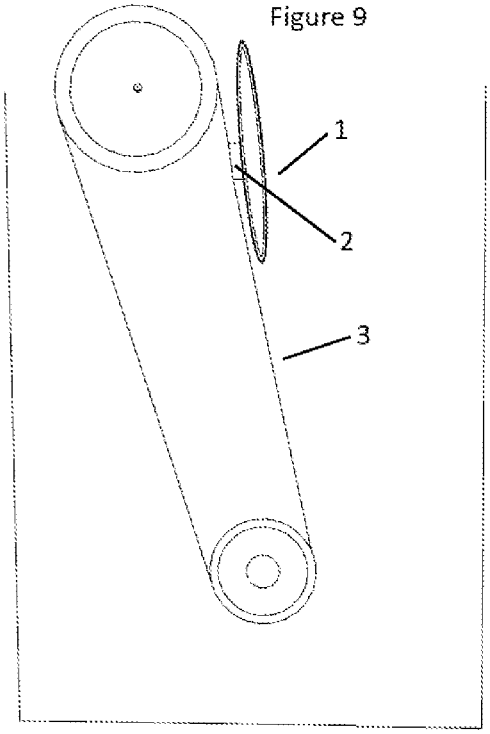

FIG. 8 shows another configuration the carousel system belt or chain in housing 3 where the tableware 1 is placed on a contact point platform such as 4 that is attached to the belt or the chain 5. The sprockets such as 2 is positioned as such where it proves an area for insertion and discharge point. The configuration of the carousel loop using multiple sprockets result in longer chain length which can be useful for high output volume by increasing the carousel speed.

Carousel Chain/Belt and Sprocket/Pulley Implementation

Figure 4:
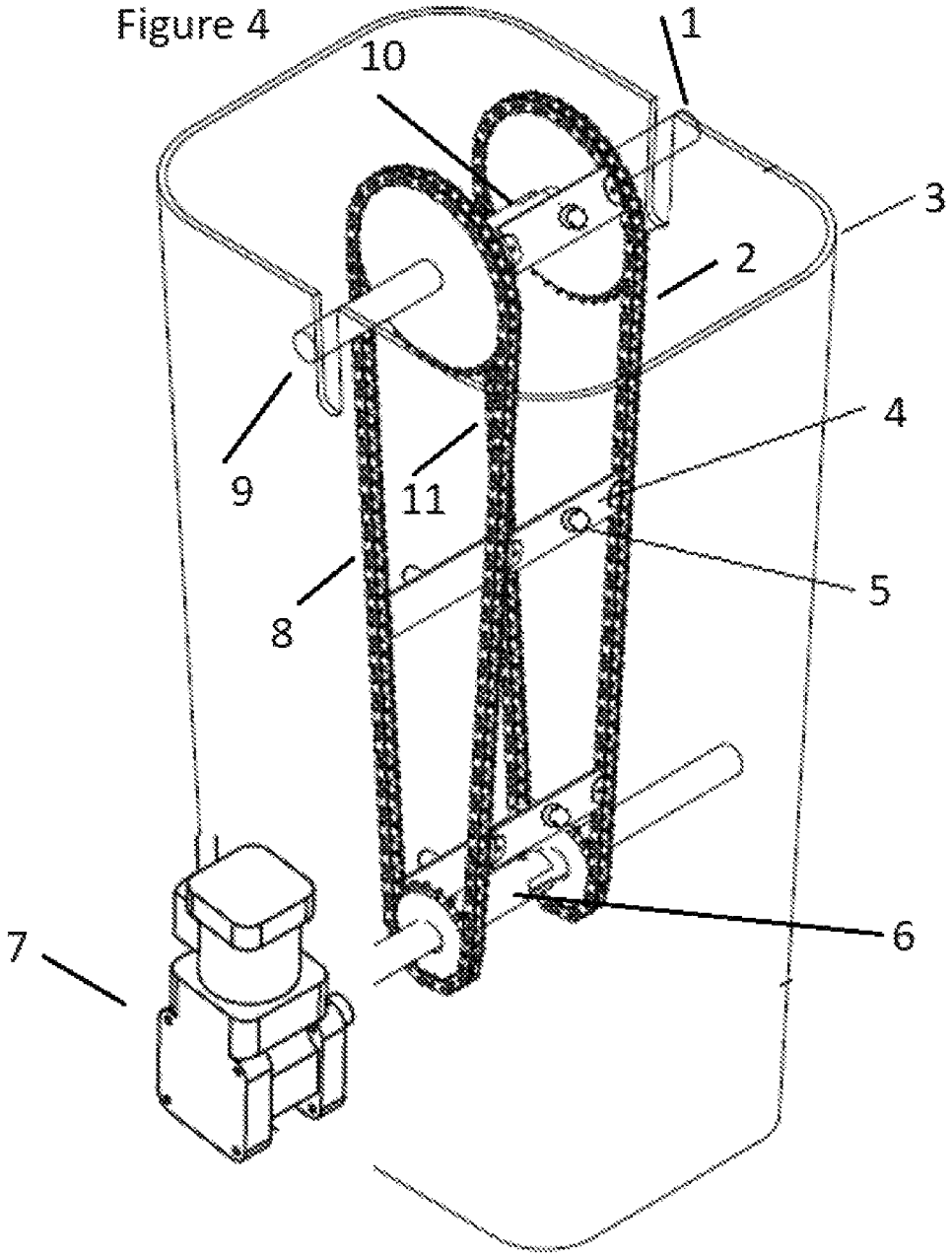
FIG. 4 shows another embodiment of the carousel having a cross-plate as a contact point.

In another embodiment, as the FIG. 4 illustrates, instead of one driver and idler sprocket or pulley, two sets of drivers and idler sprockets with connecting roller chains 2 and 8 rotate in tandem using a gear-motor 7. A cross-plate 4 is connected to chain 2 and 8 which rotates at the same speed and direction as chain 2 and 8. The cross-plate platform can contain one or more contact-point 5. As show in FIG. 4, the contact-point, in this embodiment, is a permanent magnet which require no power such as electricity to create a hold-force.

In one embodiment, the housing 3 in FIG. 4 is a non-conductive material. Two insulators 6 and 10 keep the two sets of sprockets and chain on the right- and left-hand side electrically isolated. In this case, the sprocket and the chain on both halves are electrically conductive. In this configuration, AC or DC power is supplied at 1 and 9 so that each half provides a path for electron flow. The cross-plate utilizes the power from the right and left chain to activate or deactivate contact-points at insertion and discharge point.

Figure 5:
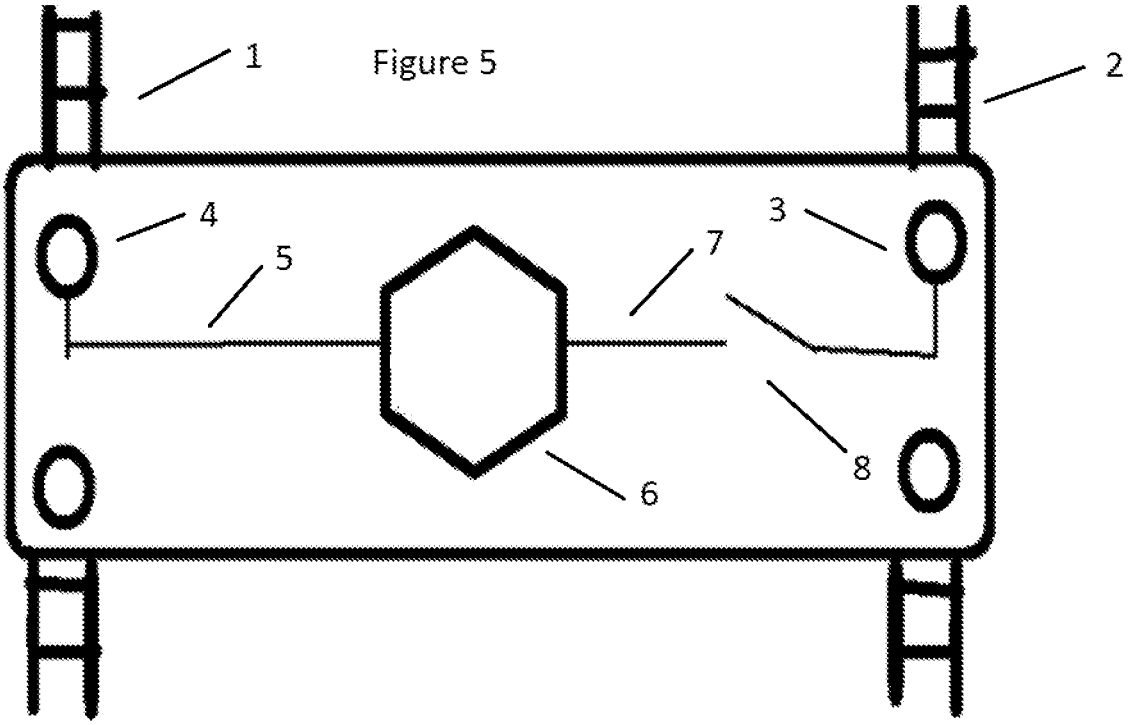
FIG. 5 shows the details of one embodiment cross-plate illustrated in FIG. 4 where power is supplied to the cross-plate to, among other services, activate and deactivate the cross-plate contact point.

FIG. 5 illustrates a cross-plate front view which is electrically non-conductive is situated between two electrically isolated chains 1 and 2 that supply enough power using 3, 4, 5 and 7 for the contact-point 6 to create a hold-force against the attached tableware.

Figure 13:
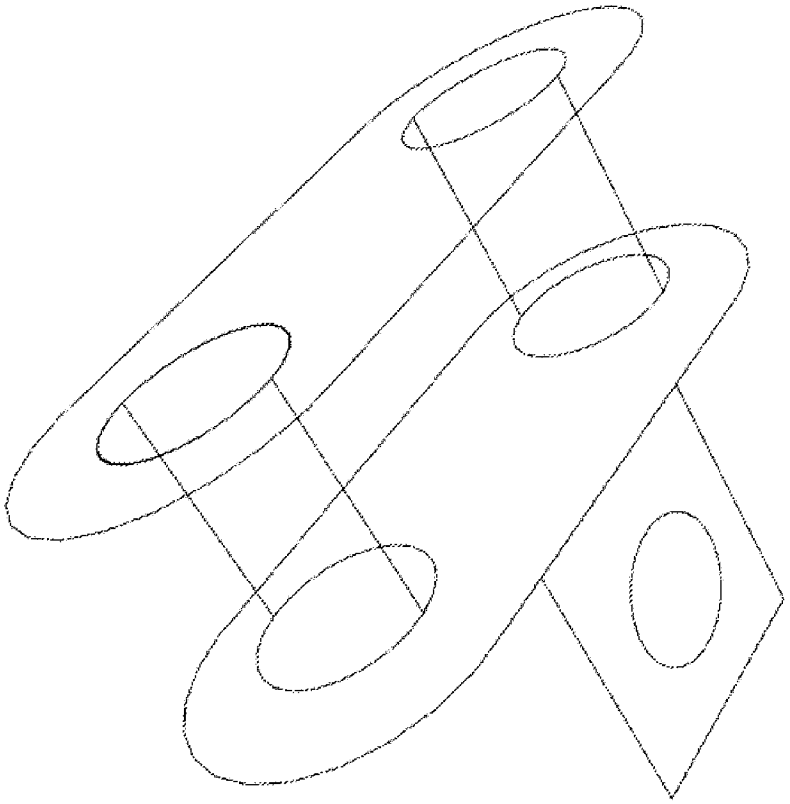

In one embodiment, the cross-plate is attached 3, 4 to the chains 1, 2 using chain link attachment shown in FIG. 13. In this example, a rolling switch 8 which, when closed at its normal state, supplies the power to the contact-point 6. When switch 8 is open no power can reach the contact-point and thus it is deactivated discharge-point using a push-down ramp to open the switch and thus cut the power to the hold-force 6.

The same chain link attachment shown in FIG. 13 may be used for one chain implementation where the one or more contact-point is connected to one or more in-line chain link attachment. For belt implementation, the cross-plate can be attached directly to the belt without an adapter.

The push-down ramp, in one embodiment, is fixed to the housing and is always in the path of the roller switch. In this embodiment, the tableware is always discharge once the roller switch is pushed down thus cutting power off to the cross-plate.

In another embodiment, the push-down ramp unit is moveable using a motor, actuator, servo or solenoid and can position itself in the path of the roller switch to discharge the attached tableware, or position itself outside of the path of the roller switch path to allow the tableware pass the discharge-point without discharging.

Since the cross-plate has available power, contact-point 6 can be an electromagnet, electric suction cup or a solenoid clamp. More importantly, since the cross-plate has power, many other means can be placed on the cross-plate. As an example, instead of a mechanical switch as 8, an optical switch can control the presence of the hold-force between the contact-points.

The state of the ramp relative to the roller switch can be reversed where the roller switch is normally open and thus a continuous ramp closes the rolling switch through the wash cycle until the discharge point where is a gap in the ramp opens the switch to discharge the tableware.

Figure 6:
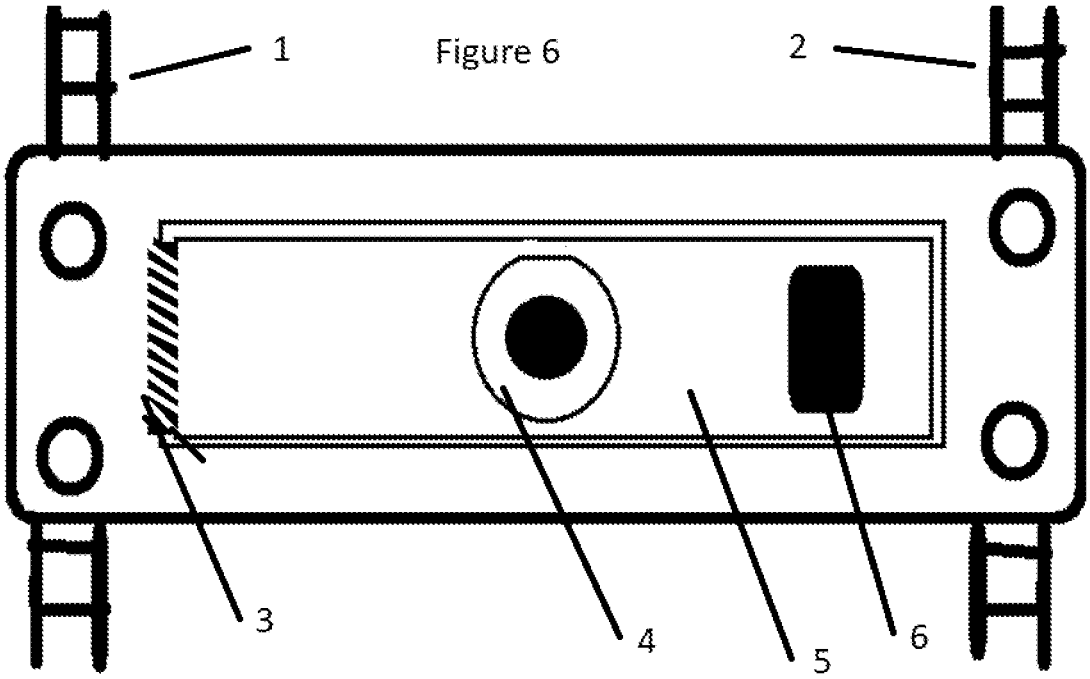
FIG. 6 shows another embodiment of the cross-plate where the contact point is mechanically moveable to separate the tableware from the contact point.

FIG. 6 shows another embodiment of the cross-plate which operates based on the rotational and kinetic energy of the carousel system. In this embodiment, the cross-plate is attached using one or more chain attachment means such as FIG. 13. An inner movable plate 5 houses the contact-point 4 and a roller wheel or a block 6. The moveable inner plate is attached to the cross-plate using a hinge and spring 3 which normally forces the inner plate to be in the same level as with the cross-plate. Tableware is attached to the contact-point 4 and is released and discharged by a ramp in the path of the wheel or the block 6 that pushes the inner plate down thus creating enough gap to counter the hold-force between the contact-point 4 and the tableware.

Carousel Contact-Point

In one embodiment, the said carousel chain designated contact-point that is attached to and travels with the rotating carousel assembly throughout the wash cycle.

In one embodiment, the one or more contact-point platform on the carousel are placed on the inner-outer edge on the surface of the carousel.

In another embodiment, one or more contact-point platform is on the carousel are the edge of the carousel.

In one embodiment, the carousel assembly is sufficiently on one of the sides within the carousel housing with one or more contact-point platform extending from the carousel sufficiently in a horizontal fashion.

In one embodiment, one or more contact-point platform is one or more metallic surface area where one or more tableware permanent magnet makes contact.

In one embodiment, the contact-point on the carousel is one or more permanent magnet where metallic surface area of the tableware makes contact.

In one embodiment, one or more contact-point is one or more suction cup.

In one embodiment, the said suction cup is mechanical and can be activated and deactivated mechanically using the kinetic and rotational energy of the carousel assembly using ramps and valleys on the suction cup's travel path to increase or decrease atmospheric pressure within the cups to create hold-force or to discharge.

In one embodiment, the contact-point is one or more clamps.

In one embodiment, the point of contact is one or more mechanical clamp and pivots that open and close using the kinetic and rotational energy of the carousel using ramps with peaks and valleys on the clamp's travel path to engage or to disengage the clamp.

In one embodiment, the shape of one or more contact-point is a flat surface.

In one embodiment, the shape of one or more contact-point is a cone-shape or dome-shaped for maximum surface area contact with tableware to hold and prevent tilting of the tableware as the tableware travels through different wash zones.

In one embodiment, the contact-point attached to the carousel contact-point platform is free-spinning contact-form where it allows the tableware to rest in its natural position based on its center of gravity as the carousel carries the contact-point through the wash-cycle. This is important for washing cups as the orientation of the cup through different stages of the carousel becomes deterministic.

In one embodiment, a rack of teeth in a rack-and-pinon gear arraignment is placed at least partially in parallel to the contact-point path where the contact-point is the pinon in such rack-and-pinon arrangement. As the carousel moves, the contact-point rolls against the rack which thus spins the tableware so that excessive water is pushed out via centrifugal force to help with washing, rinsing or draying the tableware.

Supply Electrical Power to the Carousel's Contact-Point

The previous section showed several means for the tableware to attached itself to the contact-point on the edges of the carousel system. In one embodiment, one or more permanent-magnet is used as the contact-point to create a hold-force between the tableware and the carousel system. Permanent magnet has the advantage of providing the required hold-force without electricity or any kind of external power. This is a great advantage since the hold-force will still be present when/if the dwelling wall-socket power is shutoff accidently or purposely for maintenance in the middle of the operation.

In sum, if the contact-points require electricity to hold the tableware in position on the rotating carousel system throughout the wash-cycle, during an abrupt power shutoff, an alternative source of power (such as backup power-supply) needs to be present to ensure that the tableware do not simply fall within the housing of the carousel which may cause damage to the tableware and/or the carousel system itself. At the very least, to prevent damage, the loss of electricity needs to be detected and the alternative source of electricity needs to supply enough power to the carousel assembly to immediately discharge all the tableware that are attached, to the carousel system.

As an alternative to the two-roller chain conducting power to the cross-plate, at least one isolated electrically conductive railing is placed in parallel to the contact-point travel-path which supplies enough electrical power for required hold-force to one or more traveling contact-point attached to the carousel. The metallic body of the carousel is the return path for the electron flow.

In one embodiment, the contact-point is one or more electric suction cup.

In one embodiment, the contact-point is one or more electric solenoid clamp.

In one embodiment, the contact-point is one or more electromagnet

In one embodiment the contact-points on the carousel can be the same means and method of attachment and de-attachment, or different means depending on the tableware and the contact-point for that tableware.

Carousel Insertion Point

The carousel is placed within a housing with at least one opening exposing the edges of the carousel designated as the insertion point where the user (or an automated process) inserts the soil tableware one-by-one.

In one embodiment, the insertion point and discharge point are at the same location.

In one embodiment, the insertion and discharge points are separated openings and are apart from each other. In basic embodiment, tableware is inserted into the insertion point.

In one embodiment, the insertion point has a Stop and Go visual indicator and/or physical insertion-point barrier, triggered by mechanical means using the kinetic energy of the carousel rotation momentum and power, instructs the user when to and when not to insert tableware in the insertion point.

In another embodiment, the insertion point has a Stop and Go visual indicator and/or physical insertion-point barrier, controlled by microcontroller using one or more positioning sensor for the next upcoming available contact-point, instructs the user via a visual indicator or a physical barrier when to and when not to insert tableware in the insertion point.

In another embodiment, the insertion point is a temporary holding-apparatus (such as a basket) that puts the tableware on stand-by for the next available upcoming contact-point on the carousel. In this embodiment, the user places the tableware within the holding-apparatus, and, at the right time, the holding-apparatus moves the tableware towards the carousel and attaches the tableware to the next available contact-point on the carousel. The tableware holding-apparatus movement, in one embodiment, is activated using the kinetic energy of the carousel using levers and gears. As the carousel moves down from the insertion point, an extended lever is pushed down on a gear which will move the holding-apparatus towards the carousel contact-point to attach the tableware to the carousel.

In another embodiment, the movement of the holding-apparatus is achieved using one or more actuator, motor or solenoid, controlled by one or more position sensor on the carousel itself and/or the housing. The timing is calculated based on the speed of the carousel relative to the distance of the contact-point and the holding apparatus.

In another embodiment, a microcontroller with mechanical or solid-state relay, in conjunction of one or more mechanical or solid-state positioning sensor determines the timing of the tableware to carousel attachment.

The holding apparatus will only activate with an approaching available contact-point. For example, if an already-attached tableware is going through additional wash-cycle, the holding-apparatus will keep the next tableware in the basket on stand-by until the upcoming tableware that's going through the additional wash-cycle passes through.

In another embodiment, to curtail timing complexity, when a soil tableware is inserted in the holding-apparatus, the carousel system stops at the insertion point and continues only when the tableware is attached to the contact-point.

In one embodiment, a series of tableware are queued for insertion at the insertion point.

In another embodiment, one or more tableware is inserted using an external automated means such as a robotic arm.

Carousel Discharge Point

The Discharge Point is an active or passive means to separate the tableware from the carousel system after the table has been through one or more wash-cycles. Depending on the implementation of the tableware-carousel hold-force, the discharge point has the means to halt the tableware-carousel contact-point hold-force or exert enough separation force between the tableware and contact-points to dislodge the tableware from the carousel system.

In one embodiment, the discharge assembly is static, fixed and has only one state. Once the tableware on the carousel system reaches the discharge point, the tableware is separated from the carousel assembly.

In another embodiment, the discharge point can be activated and deactivated. If active, the tableware attached to contact-point (and thus to the carousel) will separate. If de-active, the tableware is not separated and continues to go through addition wash cycle until such time when the discharge point is activated.

In one embodiment, permanent magnet is used as the hold-force to attach the tableware to the carousel system. As the carousel system moves the tableware towards the discharge point, one or more active or passive ramp guide the tableware away from the carousel contact-points. The tableware is released and dislodged when enough space is created by the separation ramp to overcome the magnetic hold-force caused by the permanent magnet and the tableware.

Figure 7:
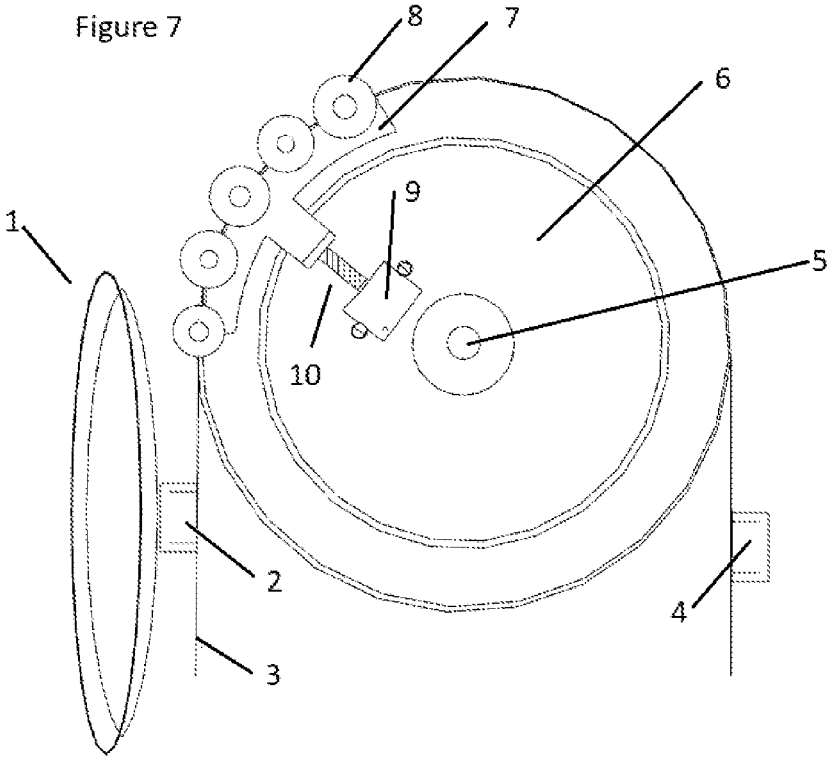
FIG. 7 shows on embodiment of separation mechanism at the discharge point where a sets of rolling wheels, when pushed in the path of the upcoming tableware at the discharge point, create enough space between the tableware and the carousel to dislodge and separate the tableware from the carousel system.

FIG. 7 shows such embodiment. As the belt or the chain 3 move the tableware 1 contact point 2 and 4 towards the discharge point, a series of rolling tires 8 attached to a platform 7 are positioned in parallel to the chain using motor 9. Motor 9 is attached to plate 6 which is help in position by the carousel housing or a cross rod as shown in 5. The rolling tires 8 form a ramp that pushes the plate away from the contact point. In another embodiment, the size and the diameter of the rolling tires increase gradually to induce and create enough space to soften the separation and to reduce jerking of the chain or the belt.

In another embodiment, using electromagnet as the hold-force between the carousel and the tableware, the power is reduced or cut-off to the carousel contact-points to separate the tableware from the carousel at the discharge point.

In another embodiment, using mechanical or electric suction cup, the separation is done by equalizing the air pressure inside of the suction cup to normal atmospheric pressure.

Tableware Stacker

In its simplest form, after the tableware is separated from the carousel system, the tableware is manually caught, sorted and stored by the user who is using the carousel system.

If the discharge point is activated, in one embodiment, that last stage of the cycle is the drying cycle where the tableware is passed through one or more air nozzle that spans across and the width of the crossing tableware. The air nozzle assembly is attached to the housing using one or more hinges which allows the air nozzle assembly to move forward or backwards. When at rest, the nozzle is tilted forward to its maximum allowable distance towards the carousel assembly. The drying of the tableware is achieved by high-pressure air coming out of the mentioned nozzle directed to the front, backside or both sides of the tableware using openings and air nozzles. On the critical surface of the tableware, a gap is produced between the mentioned nozzles and the tableware due to the high air pressure reactive force pushing against the surface of the tableware. In this embodiment, the air nozzle pointing to the critical surface of the dish has three purposes, 1) to dry the tableware 2) to prevent the tableware to fall in with the housing of the carousel after the tableware separation and 3) directing the tableware away from the carousel to a holding area which may be tableware rack or tableware stacker as illustrated in FIG. 1, at 5, 6, 7.

In one embodiment, one or more spring-loaded stacker is situated in the vicinity of the discharge point FIG. 1 at 7. Once the tableware is separated from the carousel, using gravity, the tableware slides on top of the stack.

In one embodiment, the tableware stacker is motorized which lowers the stack platform to make more room for the incoming tableware from the discharge point.

In another embodiment, once the tableware is separated from the carousel, it slides on top of a conveyor belt which moves to provide and to make room for the next tableware.

Carousel Housing

As the FIG. 3 illustrates, the carousel is housed within an enclosed container 7 that moves the tableware through different zones with specific function to clean the tableware.

In one embodiment, one of the zones is one or more jet nozzles 8, 15, or one or more bank of jet nozzles that spray and saturate the tableware with a mixture of water and detergent.

In one embodiment, one of the zones is one or more brushes (not shown in FIG. 3), or one or more bank of vertical and horizontal brushes that scrapes the particles away from the tableware front, back and sides.

In another embodiment, one zone is a quality-assurance zone where one or more optical scanner 14 scans one or more side of the tableware and, using a microprocessor, compares the current state of the tableware scan data relative to an ideal template specific for the targeted tableware. Using a weighted scale or a similar algorithm, the tableware may or may not pass the quality-assurance test. If the tableware does not pass the quality-assurance test and needs to go through additional cycles, all other upcoming zone(s) such as drying, or rinsing is disabled for that tableware to save energy, water and detergent. In such case, the tableware passes the disabled discharge-point and continues to go through additional wash cycle until such time that when the tableware passes said quality-assurance threshold, or a user configurable maximum-attempt count has been reached. If the tableware passes the quality assurance threshold, or if the maximum-attempt count has been reached, the discharge assembly is activated.

In one embodiment, one or more inline water-heater 19 is situated between the dwelling tap-water 17, through master water-valve 33, that heats the water and feeds it to a high-pressure pump 20. Water-heater 19 may or may not be present if the hot water line from the dwelling is connected in 17 and the temperature of the flowing water through 17 is constantly at an acceptable level. For example, an apartment complex may have a central heating unit that supplies hot water to multi-unit apartments instead of a single low-capacity water-heater unit for each apartment separately. If the in-line water-heater is present, a temperature sensor 18 in conjunction with in-line water-heater 19, regulates the temperature of the water. In this embodiment, the some or all output of the high-pressure pump 20 is directed to a mixer 21 which mixes the output of the pump 20 with one or more cleaning chemical flowing from one or more chemical container 22 using a flow valve 23 and pathway 28. In one embodiment, the flow is achieved using gravity by situating the chemical container 22 above the mixer 21. In another embodiment, a pump (not shown) is used to transfer the cleaning chemical agents from the container 22 to the mixer 21. In such embodiment, the output of the mixer 21 is fed to one or more nozzles 8, 15, using pathway 29 in the wash zone, or one or more bank of nozzles that covers all sides of the tableware.

In the embodiment shown in FIG. 3, for rinsing, the dwelling tap-water is directly fed to one or more rinse nozzles using pathway 26 and a valve 32. In another embodiment, some of the output from pump 20 is directed to the rinse zone.

In one embodiment, the in-line water-heater 19 as well as the pump 20 also fulfill the tasks of valves 33 and 32 by stopping or allowing water-flow to the wash-zone nozzles and/or rinse nozzles.

The carousel housing contains a drain 11 at the bottom which, in one embodiment, is connected directly to the dwelling drain 31 and subsequently to the city's sewer system. In one embodiment, the water is directly drained using the gravitational force from the drain 11 in the carousel housing 7 via pathway 30 directly to the dwelling's drain 31.

In another embodiment, the drain system is connected to multi-function, multi-pathway drain pump 25. The drain pump can be configured to drain the soil water directly to the dwelling drain system 31, or, in water-saving mode, the used soapy water is recycled back using pump 25 and value 24 for washing tableware on the carousel system.

Water-level sensor 12 is situated to monitor the water-level at the bottom of the carousel housing. In one mode of operation selected by the user, no water is recycled. In other mode of operation, 100% of the water is recycled using pump 25 with valve 24 using the pathway 27. As shown, the recycled water is fed to the water-heater 19 to compensate any water temperature lost. However, the feedback can happen at pump 20 or both using a two-way valve for optimal soap mixture and temperature.

In one embodiment, valve 24 and pump 25 can be combined into one unit.

In one basic embodiment of cleaning the soil the tableware, there is only one stage and one function. Such function can be rinsing or washing. For rinsing, dwelling tap water is fed directly to one or more nozzle pointing to the tableware. The user washes the tableware using cleaning agent chemical mixed with water manually and uses the carousel system solely for rinsing purposes using plain water.

In one embodiment, the carousel system carries the tableware through different wash zones and stages. The first stage is normally degreasing and spot removal using water mixed with one or more cleaning chemical which may include one or more brushes to physically remove the food particles away from the tableware on the carousel system. Subsequent stages include rinsing where the tableware is washed off using plain water without any chemical mixture.

In one embodiment, tableware is washed using at least high-pressure hot water or steam, mixed with cleaning chemical, with enough force through one or more nozzles strategically attached to the carousel housing to remove spots and food particles from all sides of the tableware. Depending on the different stages of the wash and settings, the incoming water from the dwelling takes different paths and is put through one more stage to change its temperature or pressure to clean the tableware.

In one embodiment, one or more water-pump, inline water heater, water temperature sensor, water-pressure sensor and chemical mixer is placed between dwelling wall tap water and one or more nozzles connected to the housing of the carousel. The connection to the wall-tap water can cold outlet, hot outlet coming from the dwelling water-heating system, or both.

In one embodiment, the incoming dwelling hot water is diverted to both wash zone and rinse zone.

As the tableware travels through different wash zones, the first stage at the insertion point is one or more rotating brushes in conjunction with high-temperature and high-pressure water mixed with a chemical agent, removes the food particles away from the tableware surface areas. The discharged food particles can be guided to a removable mesh filter holding-area where it stores the food particles but allows liquids to pass through. The holding-area can be situated in the vicinity of the brushes. The filter and the food particle holding-area is removable to allow the user to empty it.

In another embodiment, the holding area is at the bottom of the carousel just before the drain opening. The advantage of such embodiment is that food particles from both critical and non-critical surfaces of the tableware are captured throughout different wash zones.

In one embodiment, the tap-water from the wall is fed directly to one or more nozzles attached to the carousel housing. In this embodiment, the nozzle converts the volume of water from the tap, with its default water-pressure, to low-volume but high-pressure stream of water with enough force to degrease and to remove food particles and spots.

In one embodiment, one or more the same or different types of chemical mixer or water-spot remover or water softener is situated between the wall tap-water and one or more nozzle. The cleaning chemical is fed and mixed with the tap water before reaching the nozzle. Chemical mixer can be passive where the chemical, using gravity, flows from the chemical container to the mixer or directly to the tableware.

In another embodiment, the chemical is directly guided or diverted to the tableware using a dedicated one or more nozzle without mixing with water.

In another embodiment the flow of the cleaning chemical is controlled using one or more value and/or one or more pump.

In one embodiment, a high-pressure water pump is placed in-line from the dwelling tap-water and one or more nozzles.

In one embodiment, a high-pressure water pump is placed in-line from the dwelling tap-water before the chemical mixer.

In one embodiment, an in-line water heater is placed before or after the high-pressure water pump.

In one embodiment, an in-line water heater is placed before or after the chemical mixer.

In one embodiment, the dwelling hot tap water is connected to the inline water heater.

In one embodiment, one or more water temperature sensor is in-line between the dwelling hot tap-water and the in-line water heater.

In one embodiment, one or more water temperature sensor is in the path between the dwelling hot tap in-line water heater and high-pressure in-line water pump.

In one embodiment, one or more water temperature sensor is in the path between high-pressure water pump and the chemical mixer.

In one embodiment, one or more water pressure sensor is in the between the dwelling hot tap water and the in-line water heater.

In one embodiment, one or more water pressure sensor is in the between the dwelling hot tap in-line water heater and high-pressure in-line water pump.

In one embodiment, one or more water pressure sensor is in the high-pressure water pump and the detergent mixer.

Water, Energy and Detergent Saving Mode of Operation.

As descripted above, the tableware on the carousel travels through different wash zones. Due to the forces of gravity, the water, detergent or the mix of water and detergent that is sprayed on the tableware flows down to the lowest point in the carousel housing where a drain is located (FIG. 3 at 11). In one embodiment, the soil water is drained immediately using gravity or a continuous pump. In another embodiment, the soil water is not drained right way. A value is located at the bottom of the drain opens and closes based on the water level that has been accumulated at the bottom. Once the water reaches a specific level, a water-level sensor opens the drain valve for drainage. If the drain is connected to a pump, the pump will divert the water from the bottom of the carousel housing to the dwelling drain system.

In one embodiment, the drain has a loop-back pipe that connects to the input of the high-pressure pump connected using a loop-back valve. When the loop-back valve is 100% open, the mentioned valve closes the dwelling tap-water flow to the high-pressure pump and all the input to the high-pressure pump is fed through the recycled water from the drain. In this embodiment, the feedback loop valve can be open, closed or partially open. When the loop-back valve is 100% closed, the high-pressure water pump input is the dwelling tap-water with 0% recycled water from the carousel housing drain loop-back system.

In one embodiment, the loop-back pipe and the valve is positioned after the high-pressure pump or before or after the inline heater.

In one embodiment, an additional electrical heating element is positioned within the vicinity of the drain inside of the carousel housing to keep the recycled water temperature at the acceptable level for recycling to be used for washing additional tableware on the carousel. In this embodiment, the loopback is connected from the drain to the input of the high-pressure pump or the recycle water is mixed with the output of the high-pressure pump.

In one embodiment, the flow of cleaning chemical is proportional or independent to the amount of the recycle water from the carousel housing.

Wash-Pod

While the mentioned carousel system is designed to wash tableware, Wash-Pod is designed to clean kitchenware and any items such as pots and pans and irregular shaped objects that are not compliant to the carousel system. Wash-Pod is a deep housing on top of the unit as shown in FIG. 1 at 7 and in FIG. 11. Wash-Pod contains a sliding lid 3 in FIG. 11 that provides access to the inside of the Wash Pod from all sides without any vertical blockage. Wash-Pod also has a drain system at its lowest point of the Wash-Pod housing 1 where the soil water is drained. Items are placed within the Wash-Pod housing in vertical (preferred embodiment), horizontal or diagonal orientation and close the lid. Wash-Pod puts the user in control. Using the control panel discussed below, the user has the option to define duration of the wash in minutes, soap-to-water ratio and water-temperature depending of the status and the state of the item that needs to be washed.

Figure 11:
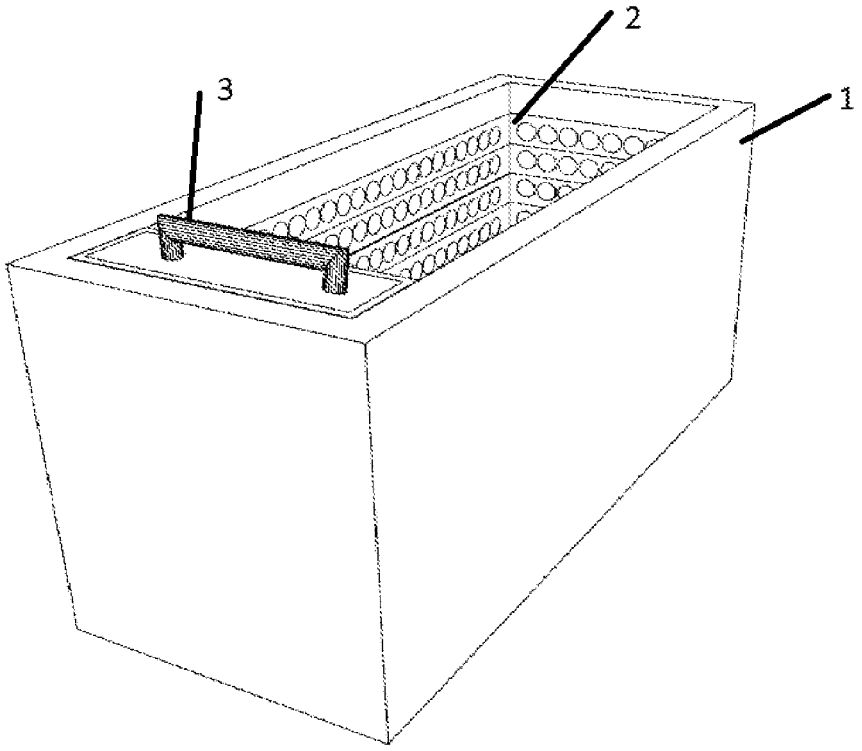
FIG. 11 is an illustration of Wash-Pod which is a deep housing for cleaning, any regular items that are not compliant with the carousel system.

As shown in FIG. 11, within the Wash-Pod housing, there a series of one or more nozzles 2 that saturate the kitchenware item with hot water or steam mixed with detergent from the FIG. 3, 22, or its own dedicated detergent housing for degreasing and spot removal. In one embodiment, the Wash-Pod has its own dedicated in-line water-heater and high-pressure pump, or the same supportive services for the carousel system can be shared with the Wash-Pod system.

In one embodiment, a dual-shaft motor is connected to two electrical clutches connected to the high-pressure pump assembly at both ends. Depending on the carousel or Wash-Pod operation, one or both electric-clutches engage would provide the rotation force and speed to the carousel pump, Wash-Pod pump or both.

In one embodiment, the water-heater has enough capacity to supply hot water or steam to both the carousel system and the wash-pod.

In one embodiment, the detergent and the means of delivery detergent is shared among the carousel and the Wash-Pod.

In one embodiment, the soil water from the Wash-Pod is drain directly to the dwelling drain system.

In one embodiment, the soil water from the Wash-Pod is fully or partially recycled in a feedback loop.

In energy or water-saving mode, in one embodiment, the hot soapy water from the carousel system is at least partially used for the Wash-Pod.

In general, while Wash-Pod is designed to complement the carousel system and its duty is to wash kitchenware items that do not fit within the carousel system, the Wash-Pod can be used to clean and sanitize any items that are washable. Since the Wash-Pod is a deep housing, it can be used to, for example, sanitize toys and other nonrelated kitchenware or tableware items.

Left-Hand and Right-Hand Insertion-Point Configurations

One of the main objectives of the present invention is prevent award body movement when using the dishwasher. The goal is to create an ergonomic environment to minimize bending or overreaching. In a typical setting, the dishwasher unit is typically located to either the left or the right-hand side of the sink or otherwise in vicinity of the sink. This is so to reduce plumbing complexity and to shorten the distance between the dishwasher and the sink.

In one embodiment of the present invention, the carousel unit assembly and, if present, the adjacent tableware-holder (such as the dish stacker as shown in FIG. 1) are an independent and moveable unit within the overall housing. The carousel housing and the tableware-holder can be repositioned, situated and configured where the insertion-point of the carousel system is the closest and adjacent to the user in a configurations where the carousel is positioned at the right-hand or left-hand of the user. Same holds true for the Wash-Pod closeable-lid where the lid can be positioned to open from left to right or from right to left.

Vertical and Horizontal Carousel System

The present invention herein preferred embodiment is vertical orientation carousel due to the consideration of floor space in limited space area such as households, apartments, company breakrooms, small businesses and other similar venues. As seen in FIG. 1, in this embodiment, the top counter surface area is removed to expose the carousel insertion point, dish stacker and Wash-Pod for east access without the user physically bending down. While the counter surface area is reduced due to such exposure, the vertical dish stacker (FIG. 1 at 7) creates more cabinet space by storing the tableware for easy access and usage.

In another embodiment of the present invention, no changes to the top counter is necessary. The carousel system insertion point can be under the counter where the carousel solid surface or roller chain and associated contact points are encapsulated all under the counter. In such embodiment, the carousel system can move and rotate in either vertical or horizontal fashion in such that there is room for easily accessible dish-storage are and Wash-Pod.

Unit Self-Health Monitoring and Cleaning,

In one embodiment mentioned, the contact point between the tableware and the carousel platform is permanent magnets to create a hold-force between the tableware and the carousel system. After continual usage, permanent magnets magnetic strength fluctuates. A sensor may be positioned within the path of such rotating permanent magnets on the carousel to monitor their magnetic strength using Hall Affect or mechanical sensor that provides feedback to the central processing unit. If the magnetic strength falls below a preset limit, that platform is marked as requiring maintenance. One or more examples of corrective action include but are not limited to:

1) General notification on the control-panel screen
2) Place that platform out of service
3) Instruct the user of how to change that magnet by opening the top cover. Once the top cover is removed, the carousel will automatically position contact point platform to the top for the user to change the permanent magnet. This process is very much like changing the printer ink cartridge.
4) In one embodiment, the carousel will position the permanent magnet within the housing where a strong magnetic coil re-magnetizes the contact point during stand by and nonoperational mode.

In one embodiment, the brushes that scrape the food from the tableware are positioned in such that they are easily removable for maintenance and cleaning. They snap on and off of their perspective holder.

In one embodiment, the one or more set of wash nozzles are positioned and situated in such that they clean the brushes in self-cleaning mode.

Reducing Automation Complexity

There are several robot design and manufacture companies such as Boston Dynamic who are attempting to create a robot for washing dishes or for placing the dishes from the sink into the rack-based dishwasher. Due to the complexity of different types and sizes of the tableware, such endeavor requires a complex optical, complex logical and complex multi-axis motor movement.

The present invention takes away such complexities from the robot which results in less complex, smaller, less expensive and more agile mechanism. One reason for such reduction of complexity is due to tableware compliancy and predictability. The contact-point on the tableware can be utilized by the robot to transfer and place the tableware in the insertion-point of the carousel system. Once the activity is detected, the unit exits sleep-mode and starts the operation. The tableware is placed through one or more wash cycles and is discharged at the discharge point.

Carousel Display and Controller

In one embodiment, one or more sections of the unit is controlled using a microprocessor or a microcontroller that provides information and feedback to the user, based on the input and feedback from one or more sensors throughout the unit. The information is displayed on a LCD or LED display, or the information is transmitted to a mobile app using Bluetooth or Wi-Fi. The user is also able to adjust operational variables. One or more feedback information and/or adjustable variables may include but are not limited to

- Master switch on or off
- Stand-by duration before sleep-mode
- Monitor activity switches and sensors to end sleep-mode by detecting tableware placement in the insertion point.
- Ensure proper operational sequence as it relates to the valves, water-heater and/or water pressure pump
- Carousel speed control
- Water-temperature
- Water-pressure
- Cleaning chemical-to-water ratio
- Drainage control for carousel and/or Wash-Pod
- Duration of the wash for Wash-Pod
- Carousel quality control system on or off
- Default number of wash cycles before discharge
- Maximum number of attempts to degrease and remove spots before discharge
- Water-Save and/or energy-save mode on or off Activity indicator for the carousel or the Wash Pod
Water-level indicator in the water and/or energy-save mode where some or all the carousel water at the bottom is recycled to clean additional tableware or kitchenware.
Report fault condition
Report Error codes and description
Emit audio tunes for different state and status (fault, finished, attention, etc.)
Usage statistics such as water consumption, energy consumption, chemical consumption, time span used, number of tableware and kitchenware washed.
Maintenance schedule
Internal self-cleaning schedule
Communication connectivity configuration and status for Wi-Fi or Bluetooth
Tableware storage (stacker or holding rack) and capacity information
Suggest corrective action(s)
Cleaning chemical level indicator
Backup battery charge indicator (if present).
Activate or deactivate tableware insertion indicator
Control tableware insertion timing
Control the on or off state of intensity of sanitization zone such as UV light
Monitor carousel position
Activate and deactivate discharge point and separation mechanism.
Control the one or more optical scanners for quality-assurance.
Caching and processing logic for image comparison between a template of an item to actual state for the purpose of quality assurance.

CONCLUSION

It will be apparent to one with skill in the art that the present and descripted invention herein may be provide using some or all of the mentioned features and components without departing from the spirit and scope of the present invention. It will also be apparent to the skilled artisan that the embodiments descripted above are specific examples of a single broader invention which may have greater scope than any of the singular descriptions taught. There may be many alterations made in the descriptions without departing from the spirit and scope of the present invention.

What is claimed:

1. An ergonomic intelligent dishwasher, comprising:
an external housing capable of holding all of the plurality of units of the ergonomic intelligent dishwasher within the housing;
a processing unit comprising at least one microcontroller;
a carousel system comprising:
a carousel housing comprising a top cover;
at least one motor;
at least one driver sprocket located in an upper region of the carousel system;
at least one idler sprocket located in a lower region of the carousel system;
at least one chain/belt;
wherein:
each of the at least one idler sprocket is connected to a respective driver sprocket through one of the at least one chain/belt, and
the at least one motor is connected to the at least one driver sprocket and configured to rotate the at least one driver sprocket and move the chain/belt in a predetermined direction;
a plurality of contact point platform connected to the at least one chain/belt, wherein the contact point platform comprises one or more contact points for attaching a tableware to contact point platform, and wherein the one or more contact points is configured to hold the tableware in a fixed position during a movement of the at least one chain/belt;
a plurality of jet nozzles configured to spray and completely saturate the tableware with a mixture of water and detergent;
a plurality of brushes configured to scrape the particles away from the tableware front, back and sides
a plurality of air nozzles configured to apply high air pressure reactive force and dry the tableware from all sides;
a position sensor in communication with the plurality of jet nozzles, the plurality of brushes, and the plurality of air nozzles, wherein the processing unit is configured to activate at least one of: the plurality of jet nozzles, the plurality of brushes, and the plurality of air nozzles based on the position of the tableware inside the carousel housing;
an optical scanner in communication with the processing unit and configured to scan one or more sides of the tableware,
wherein the processing unit is configured to:
compare the scanned data with a respective template; and
repeat a washing cycle for the tableware if the scanned data does not match the respective template; and
the scanned data is used to train/reenforce internal quality-control model;
wherein the ergonomic intelligent dishwasher further comprises:
a discharge unit located at a discharge point and configured to:
separate the tableware from the carousel system, if the discharge point is enabled by the processing unit, and
position the tableware in a dish stacker; and
a wash pod comprising:
a deep housing with a sliding lid,
a series of one or more nozzles present on the inside surface of the housing and configured to:
saturate at least one kitchenware item with hot water or steam mixed with detergent to clean the at least one kitchenware item.

2. The ergonomic intelligent dishwasher of claim 1, wherein the tableware includes at least one of flat plates, bowls, cups and the kitchenware includes utensils used for preparing and cooking the food.

3. The ergonomic intelligent dishwasher of claim 1, further comprising:
a meshed basket capable of holding at least one item inside and preventing the at least one item inside from falling off the meshed basket,
wherein the meshed basket comprises a contact point for connecting to at least one contact point platform of the plurality of contact point platform, and
wherein the at least one item comprises one of spoons, forks, knives, or cups.

4. The ergonomic intelligent dishwasher of claim 1, wherein the tableware comprises a critical surface area which makes direct contact with food and non-critical surface area which is not in direct contact with food.

5. The ergonomic intelligent dishwasher of claim 4, wherein:

the tableware comprise at least one code placed on the non-critical surface area of the tableware, the at least one code comprises at least one information;

the at least one information includes one or more of dimension and weight and attributes relating to the tableware and respective cleaning instructions, and the cleaning instructions comprises water temperature and water-pressure, as well as microcomputer-controlled wash-zone jet-spray nozzle activation configuration for optimal cleaning reach for degreasing and spot removal of tableware.

6. The ergonomic intelligent dishwasher of claim 5, wherein the at least one code comprises oner of a bar code, RFID chip, or QR code.

7. The ergonomic intelligent dishwasher of claim 1, wherein each of the contact-point platform comprises one or more mechanical suction cups to create the hold-force necessary to attach the tableware to the carousel contact-point platform.

8. The ergonomic intelligent dishwasher of claim 1, further comprises an insertion zone for attaching the tableware on at least one contact point platform of the plurality of contact point platform present on the rolling chain/belt.

9. The ergonomic intelligent dishwasher of claim 1, wherein the processing unit is configured to turn-on and turn-off one or more zone of the carousel system, wherein the one or more zones comprise a first zone including the plurality of jet nozzles, a second zone including the plurality of brushes, and a third zone including the plurality of air nozzles.

10. The ergonomic intelligent dishwasher of claim 1, wherein the processing unit is configured to control the at least one motor based the position sensor determining the position of the carousel relative to the insertion point, discharge point and one or more wash zones.

11. The ergonomic intelligent dishwasher of claim 1, wherein the at least one upper sprocket and the at least one lower sprocket is electrically isolated.

12. The ergonomic intelligent dishwasher of claim 1, wherein each of the contact-point platform comprises a cross-plate connected to the chain/belt, wherein the cross-plate comprises a contact point made up of permanent magnet for generating the hold-force for the tableware and holding the tableware at a fixed position.

13. The ergonomic intelligent dishwasher of claim 1, wherein each of the contact-point platform comprises a cross-plate connected to the chain/belt, and wherein the cross-plate comprises a contact point made up of permanent magnet for generating the hold-force for the tableware and holding the tableware at a fixed position.

14. The ergonomic intelligent dishwasher of claim 1, wherein each of the contact-point platform comprises a cross-plate connected to the chain/belt, wherein the cross-plate comprises a contact point made up of electromagnet, electric suction cup, or a solenoid clamp for generating the hold-force for the tableware and holding the tableware at a fixed position, and wherein the contact-point platform further comprises at least one of a mechanical or optical switch for controlling the presence of the hold-force between the contact-points.

15. The ergonomic intelligent dishwasher of claim 1, further comprising a backup power source configured to power the ergonomic intelligent dishwasher if AC supply is turned-off abruptly.

16. The ergonomic intelligent dishwasher of claim 1, further comprising:

a user interface for operating the ergonomic intelligent dishwasher, and a display unit comprising a plurality of display indicators for indicating a current operation the ergonomic intelligent dishwasher.

17. The ergonomic intelligent dishwasher of claim 1, wherein the discharge unit comprises:

a motor;

a series of rolling tires attached to a platform and are positioned in parallel to the chain/belt using the motor, wherein the series of rolling tires form a ramp that pushes the tableware away from the contact point towards the dish stacker.

18. The ergonomic intelligent dishwasher of claim 17, wherein the processing unit to configured to enable the discharge unit, if the scanned data of the tableware matches the respective template or a completion of maximum number of wash cycles is detected.

19. The ergonomic intelligent dishwasher of claim 1, wherein one or more items are placed inside the wash pod in a horizontal, vertical, or diagonal orientation and the sliding lid is closed, and wherein the ergonomic intelligent dishwasher comprises a user interface for defining a plurality of parameters associated with a wash as per user preference and need.

20. The ergonomic intelligent dishwasher of claim 1, further comprising:

a sensor in communication with the processing unit and configured to monitor a magnetic strength of a permanent magnet placed at the contact point, wherein the processing unit is configured to generate an alert via at least one indicator present on the display unit, if the magnetic strength of the permanent magnet is below a predetermined threshold.

* * * * *